US010413464B2

(12) United States Patent
Lachenbruch et al.

(10) Patent No.: US 10,413,464 B2
(45) Date of Patent: Sep. 17, 2019

(54) MULTI-MODE SACRAL UNLOADING PRESSURE RELIEF IN A PATIENT SUPPORT SURFACE

(71) Applicant: Hill-Rom Services, Inc., Batesville, IN (US)

(72) Inventors: Charles A Lachenbruch, Batesville, IN (US); Rachel L Williamson, Batesville, IN (US); Kathryn Smith, Batesville, IN (US); Robert M Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 456 days.

(21) Appl. No.: 15/138,353

(22) Filed: Apr. 26, 2016

(65) Prior Publication Data

US 2016/0324707 A1 Nov. 10, 2016

Related U.S. Application Data

(60) Provisional application No. 62/156,966, filed on May 5, 2015.

(51) Int. Cl.

| | |
|---|---|
| ***A61G 7/05*** | (2006.01) |
| ***A61G 7/057*** | (2006.01) |
| ***A47C 27/08*** | (2006.01) |
| ***A47C 27/10*** | (2006.01) |
| *A61G 7/00* | (2006.01) |

(52) U.S. Cl.

CPC ..... *A61G 7/05* (2013.01); *A47C 27/082* (2013.01); *A47C 27/083* (2013.01); *A47C 27/10* (2013.01); *A61G 7/05769* (2013.01); *A61G 7/001* (2013.01); *A61G 2200/322* (2013.01)

(58) Field of Classification Search

CPC ..... A61G 7/05
USPC ..... 5/710, 713, 706
See application file for complete search history.

(56) References Cited

U.S. PATENT DOCUMENTS

| | | | |
|---|---|---|---|
| 3,867,732 | A | 2/1975 | Morrell |
| 3,895,404 | A | 7/1975 | Wilson et al. |
| 4,017,921 | A | 4/1977 | Hernandez |
| 4,193,149 | A | 3/1980 | Welch |
| 4,231,355 | A | 11/1980 | Hara |
| 4,347,633 | A | 9/1982 | Gammons et al. |
| 4,518,200 | A | 5/1985 | Armstrong |
| 4,660,388 | A | 4/1987 | Greene, Jr. |
| 4,793,651 | A | 12/1988 | Inagaki et al. |

(Continued)

FOREIGN PATENT DOCUMENTS

WO 2014081521 A2 5/2014

OTHER PUBLICATIONS

Search report from counterpart EP application No. EP16168176, 8 pages.

*Primary Examiner* — Fredrick C Conley
(74) *Attorney, Agent, or Firm* — Barnes & Thornburg LLP

(57) ABSTRACT

According to the present disclosure, a patient support apparatus includes a mattress having an air bladder system configured to sense pressure levels along the mattress surface and perform unloading of mattress areas corresponding to specific patient body areas to relief loading to the area, and to perform unloading independently or in combination with lateral rotation. The air bladder system may include a support bladder system and a rotation bladder system.

21 Claims, 8 Drawing Sheets

(56) References Cited

U.S. PATENT DOCUMENTS 4,840,425 A 6/1989 Noble
4,896,389 A 1/1990 Chamberland et al.
4,921,301 A 5/1990 Haynes
4,941,221 A 7/1990 Kanzler
4,947,500 A 8/1990 Seiler
4,986,260 A 1/1991 Iams et al.
5,022,110 A 6/1991 Stroh
5,044,029 A 9/1991 Vrzalik
5,052,067 A 10/1991 Thomas et al.
5,062,167 A 11/1991 Thomas et al.
5,065,466 A 11/1991 Thomas et al.
5,073,999 A 12/1991 Thomas et al.
5,095,568 A 3/1992 Thomas et al.
5,103,518 A 4/1992 Gilroy et al.
5,121,513 A 6/1992 Thomas et al.
5,135,282 A 8/1992 Pappers
5,142,719 A 9/1992 Vrzalik et al.
5,152,021 A 10/1992 Vrzalik et al.
5,182,826 A 2/1993 Thomas et al.
5,211,162 A 5/1993 Gillen, Jr. et al.
5,251,349 A 10/1993 Thomas et al.
5,267,364 A 12/1993 Volk
5,396,671 A 3/1995 Stacy
5,493,742 A 2/1996 Klearman et al.
5,509,155 A 4/1996 Zigarac et al.
5,564,142 A 10/1996 Liu
5,603,133 A 2/1997 Vrzalik et al.
5,606,754 A 3/1997 Hand et al.
5,666,681 A 9/1997 Meyer et al.
5,687,438 A 11/1997 Biggie et al.
5,701,622 A 12/1997 Biggie et al.
5,755,000 A 5/1998 Thompson et al.
5,802,645 A 9/1998 Vrzalik et al.
5,901,393 A 5/1999 Pepe et al.
5,926,874 A 7/1999 Browder
5,983,429 A 11/1999 Stacy et al.
6,098,222 A 8/2000 Hand et al.
6,134,732 A 10/2000 Chapman et al.
6,151,739 A 11/2000 Meyer et al.
6,163,909 A 12/2000 Lin et al.
6,253,402 B1 7/2001 Lin
6,266,833 B1 7/2001 Lin
6,282,737 B1 9/2001 Vrzalik
6,351,863 B1 3/2002 Meyer et al.
6,651,283 B1 11/2003 Cook et al.
6,695,798 B2 2/2004 Chang
6,711,771 B2 3/2004 Cook et al.
6,789,284 B2 9/2004 Kemp
6,820,640 B2 11/2004 Hand et al.
6,823,549 B1 11/2004 Hampton et al.
7,716,762 B2 5/2010 Ferraresi et al.
7,761,945 B2 7/2010 Butler
7,784,130 B2 8/2010 Pile
7,849,544 B2 12/2010 Flocard et al.
8,104,126 B2 1/2012 Caminade et al.
8,261,388 B1 9/2012 Gill et al.
8,429,774 B2 4/2013 Tarsaud et al.
8,601,622 B1 12/2013 Garnero et al.
8,745,788 B2 6/2014 Bhai
8,789,224 B2 7/2014 Wyatt et al.
8,863,338 B2 10/2014 Dzioba et al.
8,973,186 B2 3/2015 Bhai
9,101,224 B2 8/2015 Chiang et al.
9,216,122 B2 12/2015 Dzioba et al.
9,308,393 B1 4/2016 Olvera
2002/0128572 A1 9/2002 Chang
2004/0031103 A1 2/2004 Wyatt et al.
2004/0226102 A1 11/2004 Hampton et al.
2004/0261796 A1 12/2004 Butler
2007/0073365 A1 3/2007 Butler
2008/0178392 A1 7/2008 Chu
2008/0271253 A1 11/2008 Pile
2010/0063638 A1* 3/2010 Skinner ..... A61G 7/05769 700/281
2011/0173758 A1 7/2011 Fontaine
2011/0203053 A1 8/2011 Mulliez et al.
2011/0308019 A1* 12/2011 Terawaki ..... A61G 7/05769 5/713
2012/0317720 A1 12/2012 Chiang et al.
2013/0145558 A1 6/2013 Bhai
2014/0173825 A1 6/2014 Chiang et al.
2014/0317855 A1 10/2014 Stevens et al.

* cited by examiner

MULTI-MODE SACRAL UNLOADING PRESSURE RELIEF IN A PATIENT SUPPORT SURFACE

CROSS-REFERENCE TO RELATED APPLICATIONS

The present application claims the benefit, under 35 U.S.C. § 119(e), of U.S. Provisional Application No. 62/156,966, filed May 5, 2015, which is hereby incorporated by reference herein.

BACKGROUND

The present disclosure relates to patient support apparatuses, such as hospital beds, for example, which include active support surfaces. More specifically, the present disclosure relates to patient support apparatuses which detect a patient's position and change operating characteristics of the patient support apparatus based on the patient's position.

Patient support apparatuses, such as hospital beds, for example, include actuators for moving articulated sections. In addition, the beds may include mattresses that have various bladder structures which support the patient and, in some cases, move the patient to provide therapy.

When a person is supported on a patient support apparatus for an extended time, there is the potential for certain hospital acquired conditions to be induced. For example, relatively immobile patients are prone to develop pressure ulcers (also known as bed sores) due to friction developed between the patient's skin and the surface. This is further exacerbated by patient sweat and increased temperature at the interface. Furthermore, patients who are relatively immobile are prone to develop pulmonary complications, including fluid and mucous buildup in the lungs.

SUMMARY

The present application discloses one or more of the features recited in the appended claims and/or the following features which, alone or in any combination, may comprise patentable subject matter:

According to the present disclosure, a patient support apparatus includes a mattress having plurality of inflatable support cushions for supporting a patient's body, and a controller having at least one processor and at least one memory device including instructions that, when executed by the at least one processor, (i) determine a position of the patient's body on the mattress and (ii) select at least one inflatable support cushion of the plurality of inflatable support cushions as a target inflatable support cushion for deflation based on the determined position of the patient's body.

In some embodiments, the controller selects the target inflatable support cushion based on a location of greatest pressure.

In some embodiments, the controller receives a least one pressure signal indicating the location of greatest pressure, and selects the target inflatable support cushion based on the pressure signal.

In some embodiments, the controller deflates the target inflatable support cushion and inflates at least one inflatable support cushion adjacent to the target inflatable support cushion.

In some embodiments, an inflation amount of the at least one adjacent inflatable support cushion is one of a predetermined amount and a calculated amount, to unload a sacral region and or a trochantal region without unduly increasing pressure in surrounding areas.

In some embodiments, the controller selects the target inflatable support cushion based on a user input.

In some embodiments, the patient support apparatus includes at least one pressure sensor for each of the plurality of inflatable support cushion selected from the group of: piezo electric pressure sensor, an immersion sensor, a tape switch, and pressure-sensitive fabric.

In some embodiments, the patient support apparatus includes at least one rotation actuator, wherein the at least one memory device includes instructions that, when executed by the at least one processor, operate the at least one rotation actuator such that the mattress performs a lateral rotation.

In some embodiments, the target inflatable support cushion corresponds to a location of a patient's trochanter.

In some embodiments, the controller adjusts at least one parameter of the lateral rotation based on a user adjustment input.

In some embodiments, the controller selects the target inflatable support cushion based on a user input.

In some embodiments, the at least one rotation actuator; wherein the user input is a user selection of one of a supine position, a fetal position, and a custom target cushion mode.

In some embodiments, the at least one memory device includes instructions that, when executed by the at least one processor in response to user selection of the supine position, select the target inflatable support cushion as one of the plurality of inflatable support cushions located about 2-3 inches headward of an area of greatest pressure.

In some embodiments, the at least one memory device includes instructions that, when executed by the at least one processor in response to user selection of the fetal position, select the target inflatable support cushion as one of the plurality of inflatable support cushions located at an area of greatest pressure.

In some embodiments, the at least one memory device includes instructions that, when executed by the at least one processor in response to user selection of the custom target cushion mode, select the target inflatable support cushion as one of the plurality of inflatable support cushions based on a user selection of a specific inflatable cushion of the plurality.

In some embodiments, the target inflatable support cushion corresponds to a location of a patient's sacrum.

In some embodiments, the patient support apparatus includes at least one rotation actuator; wherein the at least one memory device includes instructions that, when executed by the at least one processor, operate the at least one rotation actuator such that the mattress performs a lateral rotation.

In some embodiments, the controller receives a least one pressure signal indicating the location of greatest pressure during the lateral rotation, and selects the target inflatable support cushion based on the pressure signal.

In some embodiments, the lateral rotation is a continuous lateral rotation cycle and the controller selects the target inflatable support cushion based on a current position of the continuous lateral rotation therapy cycle.

In some embodiments, the current position is one of a rightward inclination, a horizontal position, and a leftward inclination.

In some embodiments, the plurality of inflatable support cushions includes independently controllable bladders disposed laterally across a central region of the mattress.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
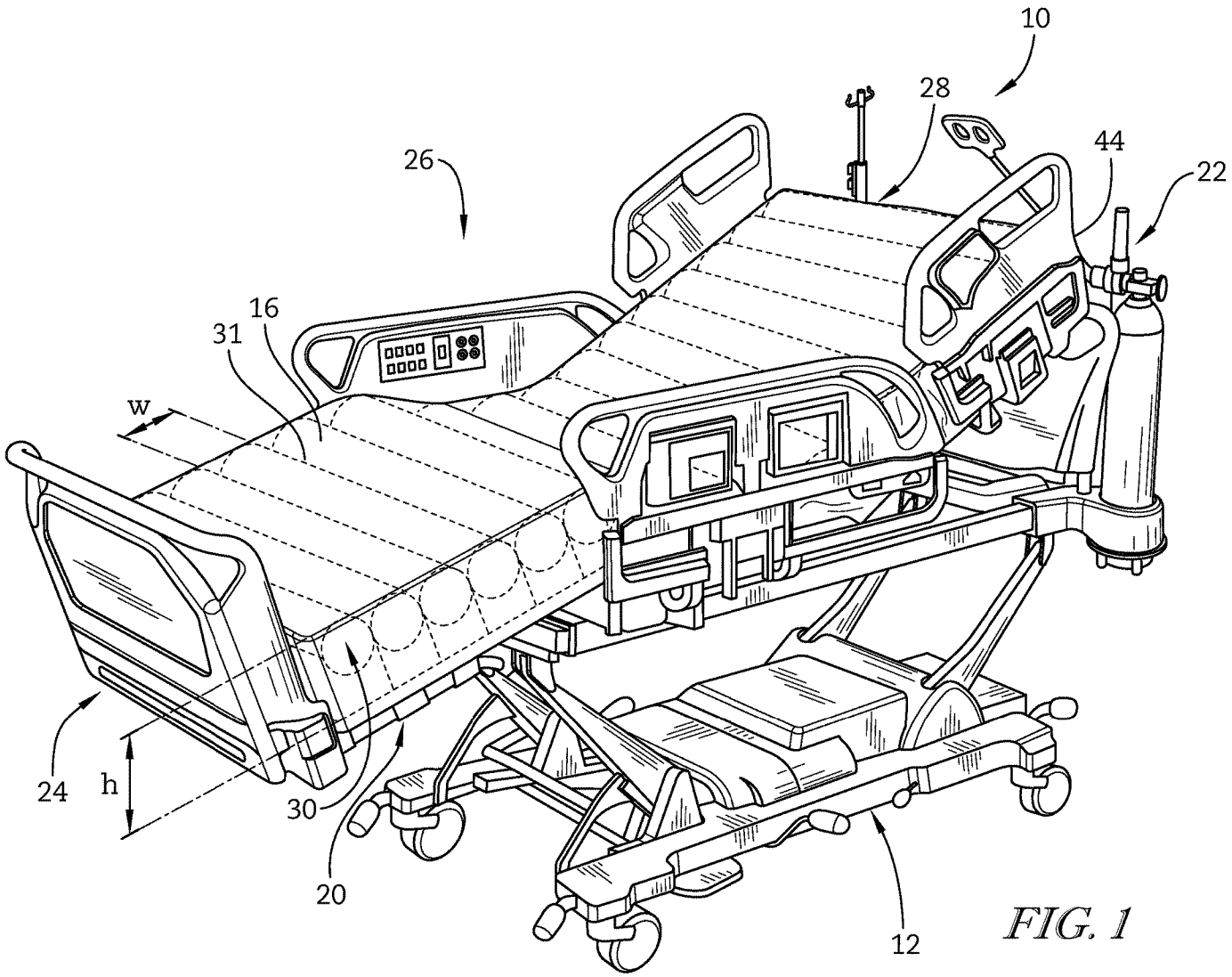
FIG. 1 is a perspective view of a patient support apparatus including a patient support surface supported on a frame structure.

An illustrative patient support apparatus embodied as a hospital bed 10 is shown in FIG. 1. The bed 10 includes a head end 22 and a foot end 24. The bed includes a frame 12 extending from a floor and including an articulated deck 20 that includes a number of sections that are pivotable relative to one another to change the orientation of the deck 20. The bed 10 includes a patient support surface 16 illustratively embodied as an upper surface 31 of a mattress 28 for supporting a patient, the mattress 28 supported on the deck 20. The bed 10 also includes a control system 111 operable, among other things, to determine the location of the patient's body experiencing the greatest load pressure on the mattress 28 and a specific support bladder 30 relative to the location of the patient's body, and to automatically unload the specific (target) support bladder 30 to reduce the pressure on the patient's sacrum and or trochanter, depending on the orientation of the patient.

Figure 2:
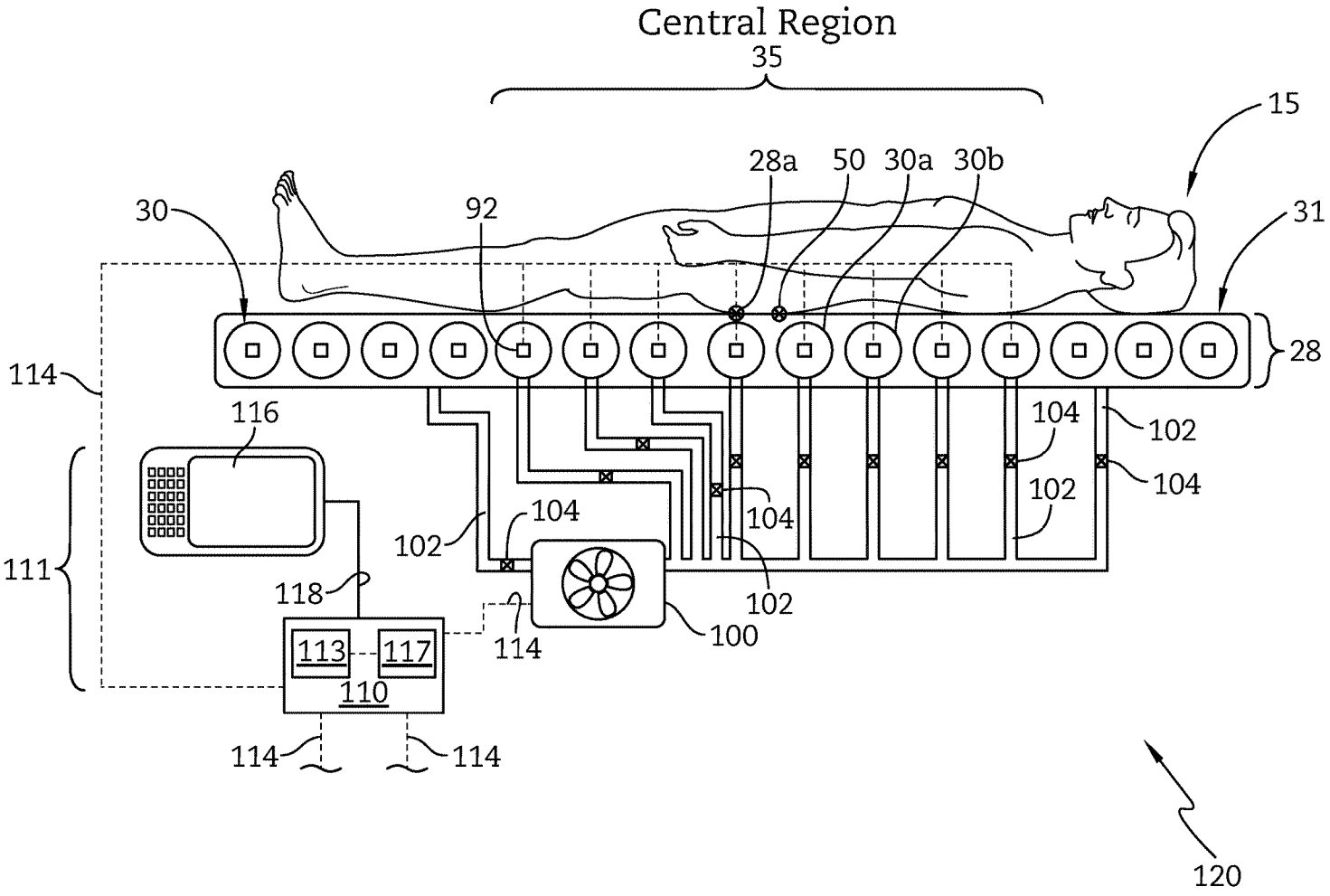
FIG. 2 is a diagrammatic view of a portion of a control system of the patient support apparatus used to operate a support bladder system of the patient support surface of FIG. 1.

FIG. 2 shows a support bladder system 1000 of the bed 10. The support bladder system 1000 includes the plurality of support bladders 30 of the mattress 28. In the illustrative embodiment, the support bladders 30 are oriented laterally across the mattress 28 and run successively from the head end 22 to the foot end 24 of the bed 10. The support bladders 30 each have generally the same size, shape, and are positioned without any spaces between adjacent support bladders 30. The support bladders 30 are located beneath an upper mattress surface 31. In some embodiments, the support bladders 30 may be limited to be positioned over a portion or portions of the mattress 28, oriented with the same or varying spaces between adjacent support bladders 30, and or as having the same or different spacing, dimensions, shape, or other configuration to accommodate particular correspondence to a patient's body regions or other features of a specific embodiment of mattress. In some embodiments, the support bladders 30 may be oriented beneath, inside, or above other portions of the mattress 28, for example, upper mattress surface 31.

By determining the location of greatest load pressure of the patient support surface 16 over the support bladders 30 of the mattress 28, it has been found that the location of the patient's sacrum 50 can be very accurately identified relative to patient support surface 16. In the supine position, the location of the support bladders 30 having the greatest pressure (other than those support bladders 30 in the heel region of the mattress 28) nearly always corresponds to the location of the patient's ischial tuberosities (IT) relative to the patient support surface 16. Empirical testing has produced pressure maps which have shown that a patient's sacrum is located approximately 2-3 inches (5-7.6 cm) headward of the site of the IT. Thus, by accurately determining the location of greatest pressure on the patient support surface 16, the location of a patient's sacrum 50 can be accurately inferred.

By depressurizing the specific support bladder 30 corresponding to the location of the sacrum 50, and pressurizing support bladders 30 adjacent to the location of the sacrum 50 to increase the support pressure in the area surrounding the sacrum 50, the patient's back can be properly unloaded when the patient is in the supine position.

Similarly, when a patient is determined to be in a fetal position, determining the location greatest load pressure on the patient support surface 16, it has been found that the location of the patient's trochanter 60 can be very accurately identified relative to the patient support surface 16. In the fetal position, the location of patient support surface 16 having the greatest load pressure corresponds directly with the location of the patient's trochanter 60. Thus, the location of the patient's trochanter 60 can be accurately inferred in the fetal position.

By depressurizing the specific support bladder 30 corresponding to the location of the trochanter 60, and pressurizing support bladders 30 adjacent to the location of the trochanter 60 to increase the support pressure in the area surrounding the trochanter 60, the patient's trochanter 60 can be properly unloaded when the patient is in the fetal position.

In the illustrative embodiment, the support bladders 30 are oriented successively across at least a central region of the mattress 28. The support bladders 30 each have a width w from head end 22 to foot end 24 of the bed 10 equal to or less than about 3 inches. Each support bladder 30 has a height h somewhat greater than its width w. In some embodiments, each support bladder 30 may have various sizes, shapes, proportions, and configurations including various heights, widths, and relative proportions thereof.

As shown in FIG. 2, a support bladder pressurization system 120. A pressurized fluid source 100 is connected to one or more of the support bladders 30 by a network of fluid supply tubes 102 and corresponding valves 104 for supplying pressurized fluid, typically ambient air, to the support bladders 30. In the illustrated embodiment, the pressurized fluid source 100 is a single blower connected to each of the support bladders 30 by at least one dedicated valve 104 and at least one dedicated fluid supply tube 102. In some embodiments, the pressurized fluid source may be one or more pumps, compressors, fans, other pressurizers and or any combination thereof. In some embodiments, the pressurized fluid source 100 may be connected to multiple support bladders 30 through a plurality of valves 104 and or a plurality of tubes 102 or through a manifold arrangement.

In the illustrative embodiment, the pressurized fluid source 100 is operated to compress fluid and transfer the fluid into the support bladders 30 to thereby increase the pressure in the support bladders 30. The valves 104 are operated to control the flow of the fluid, to and or from the support bladders 30. The pressurized fluid source 100 can also be operated in a vacuum to assist with the removal of fluid out of the support bladders 30, thereby reducing the pressure in the support bladders 30. In some embodiments, valves 104 may facilitate venting a support bladder 30 to atmosphere to reduce the pressure in the support bladder 30.

A control system 111 includes a user interface 116, a controller 110 and several communication links 114. User interface 116 is configured to allow a bed occupant, a caregiver, or other user to communicate user inputs to the controller 110 by way of a number of communication links 114. The controller 110 communicates with pressurized fluid source 100 by way of a communication link 114. Pressure readings from pressure sensors embodied as pressure transducers 92 associated with each of the support bladders 30 are communicated to the controller 110 by communication links 114. The pressure readings from the pressure transducers 92 are indicative of the pressure in the respective support bladders 30. In the illustrative embodiment, the pressure transducers 92 are individual piezo electric pressure sensors for support bladder 30 which are in direct fluid communication with the interior of the corresponding support bladder 30. In some embodiments, pressure sensing may be determined by one or more immersion sensors, tape switches, force sensing resistors, pressure sensitive fabric, load cells, or any other load or pressure sensing device for each support bladder 30. Although embodied as a single transducer 92 for each support bladder, multiple sensors may be used with any support bladder 30.

The controller 110 comprises at least one processor 113 and at least one memory device 117. The memory device 117 stores instructions for execution by the processor 113. The controller 110 receives information from the pressure transducers 92 and the user interface 116, via the communication links 114, as inputs to the processor 113 in executing the instructions stored in the memory device 117, and outputs signals to the pressurized fluid source 100, to the fluid control valves 104, and or to other components of the bed 10 to control the operation of the patient support surface 16. The controller 110 controls each support bladder 30 individually. In some embodiments, the controller 110 may also control groups of support bladders 30 organized in zones. The instructions stored in the memory device 117 include at least one control algorithm. Controller 110 instructions may also include reference charts, lookup tables, or the like and may be updated through a communication link (not shown) to support debugging, enhanced features, and or updated control design. The communication link may be a connector that allows an external device to mechanically connect to controller 110 to create an electrical connection or may be a wireless link between an external device and the controller 110.

Figure 3:
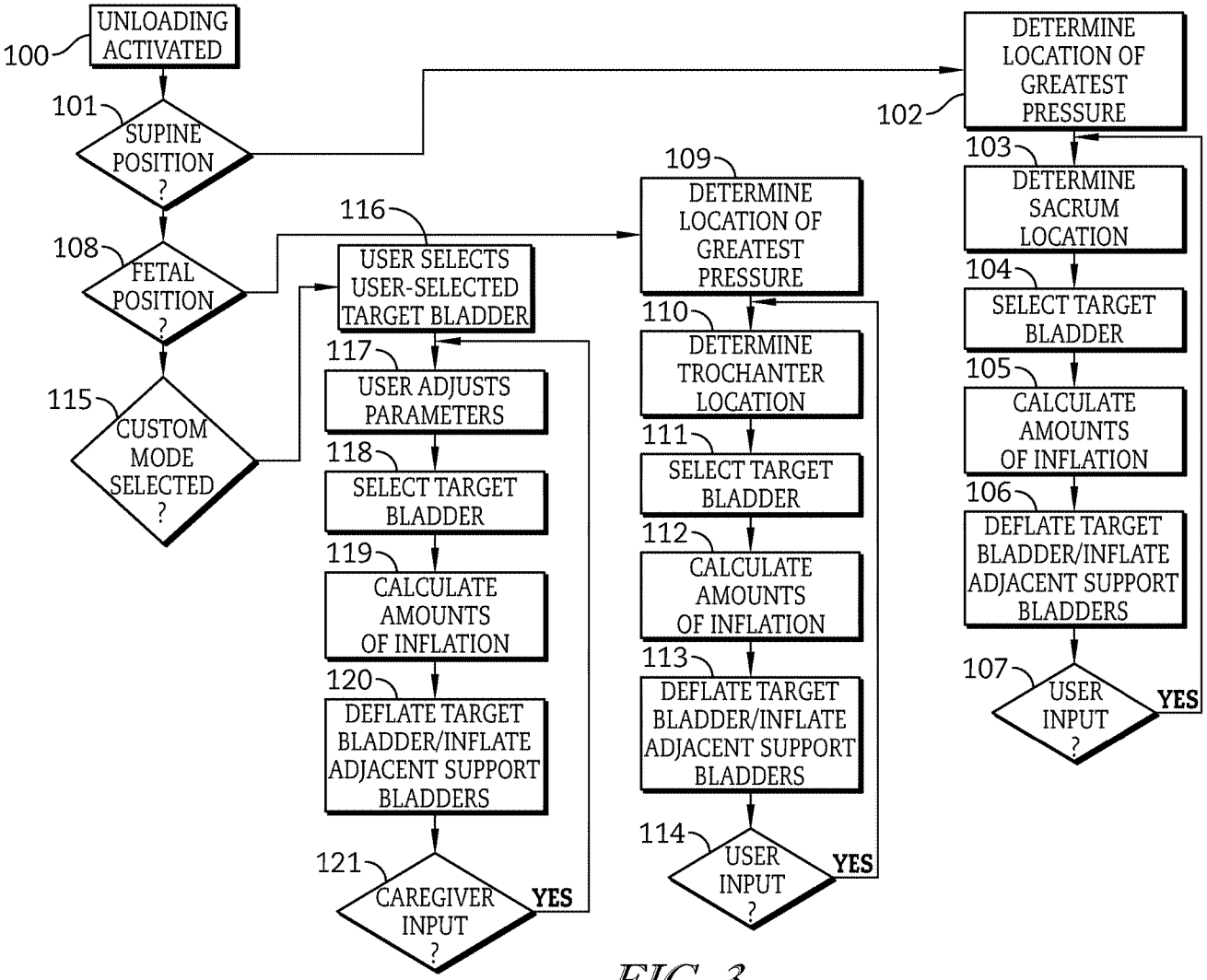
FIG. 3 is a flow diagram of a process executed by the control system of the patient support apparatus for selecting an unloading a bladder of the support bladder system of the patient support surface of FIG. 1.

FIG. 3 indicates a flow chart of an unloading sequence, and the steps of the unloading sequence are described in detail hereafter. During the unloading sequence, a support bladder 30 relating to a specific portion of a patient's body is selected and depressurized to relieve contact pressure between the specific portion of the patient's body and the mattress 28. At step 100 of the illustrative embodiment, unloading is initiated directly by user initiation via the user interface 116. In some embodiments, unloading may be directly or indirectly initiated by periodic initiation, by a triggering event, user initiation, and or any combination thereof. The controller 110 receives communication from the transducers 92 indicating the pressure within each support bladder 30. At step 101 of the illustrative embodiment, the controller 110 determines whether the patient 15 is in a supine position by determining if a user has selected the supine position on the user interface 116. In some embodiments, the controller 110 may determine whether the patient is in the fetal position by execution of instructions stored in the memory device 117 by processor 113 based on pressure inputs from the transducers 92 and or other inputs received from other bed components. At steps 102-104, the controller selects the target support bladder 30*a* from the support bladders 30 based on inputs from any of the transducers 92 and the user interface 116. At steps 105-106, the controller 110 calculates the amount of inflation to be provided to adjacent support bladders 30*b* to achieve unloading and communicates command signals to any of the pressurized fluid source 100, valves 104, and or any other bed components to achieve the calculated amounts of inflation. At step 107, new user input can be inputted to the unloading sequence.

At step 102, the controller 110 determines the location of greatest load pressure 28*a* on the patient support surface 16 based on inputs from the transducers 92 indicating the pressure levels within the support bladders 30. The processor 113 executes instructions stored in the memory device 117 according to inputs from the transducers 92 to determine the location of greatest load pressure 28*a* on the patient support surface 16. The controller 110 stores the determined location of greatest load pressure 28*a*, load input information, and other inputs in the memory device 117. In the illustrative embodiment, the controller 110 determines the location of greatest load pressure 28*a* of the patient support surface 16 based on pressure inputs from the transducers 92 of the mattress 28. In some embodiments, the controller 110 determines the location of greatest load pressure 28*a* on the patient support surface 16 based on transducer 92 inputs from one or more specific regions of the mattress 28, such as the central region 35.

At step 103, the processor 113 executes instructions stored in the memory device 117 to determine the location of the patient's sacrum 50 based on the determined location of greatest load pressure 28*a* from step 102. The processor 113 determines the location of the sacrum 50 by executing instructions which identify a location on the mattress 28 corresponding to a location about 2-3 inches headward of the determined location of greatest load pressure 28*a*.

The controller 110, at step 104, selects the support bladder 30 corresponding to the location of the patient's sacrum 50, as the target support bladder 30*a*. The processor 113 executes instructions stored in the memory device 117 to select the support bladder 30 which best corresponds to the location of the patient's sacrum 50 identified at step 103. In the illustrative embodiment, the support bladder 30 best corresponding to the location of the patient's sacrum is the support bladder 30 located about 2-3 inches headward of the location of greatest load pressure 28*a* on the patient support surface 16. The controller 110 deems the selected support bladder 30 as the target support bladder 30*a* and stores the selection in the memory device 117.

At step 105, the controller 110 calculates the amount of inflation to be provided to the adjacent support bladders 30*b*. The processor 113 executes instructions stored in the memory device 117 to calculate the amounts of inflation required of each of two adjacent support bladders 30*b* which are adjacent to the target support bladder 30*a*. The instructions include a number of control algorithms to determine a required amount of increased support pressure to accommodate unloading of the sacrum without unduly increasing the interface pressure in the surrounding areas of the patient 98. The controller 110 receives communication of inputs from the transducers 92 indicating the pressure within the support bladders 30. The controller 110 determines the amount of inflation of the adjacent support bladders 30*b* based on the inputs received by the controller 110. In the illustrative embodiment, the amounts of inflation are calculated based on the total patient's body weight as indicated by the inputs from the transducers 92, and the adjacent support bladders 30*b* are embodied as one support bladder 30 directly adjacent either side of the target support bladder 30*a*. In some embodiments, the amounts of inflation may be calculated based on the particular distribution of the patient's body weight, inputs from the user interface 116, other inputs to the controller 110 indicating bed configuration, and or any combination thereof; and the adjacent support bladders 30*b* may include any number of support bladders 30 on either side of the target support bladder 30*a*. In the illustrative embodiment, the amounts of inflation of the adjacent support bladders 30*b* are embodied as individual amounts of inflation. In some embodiments, the amounts of inflation may be common to adjacent support bladders 30*b*.

The controller 110, at step 106, communicates to the pressurized fluid source 100 and fluid valves 104 to deflate the target support bladder 30*a* and to inflate the adjacent support bladders 30*b* their respective amounts of inflation according to step 105. The processor 113 sends command signals to the pressurized fluid source 100 and fluid valves 104 indicating the required valve positions and fluid source operating conditions to achieve the pressure levels determined at step 105. The unloading sequence has been described to require deflation of the target support bladder 30*a*, and inflation of the adjacent support bladders 30*b*, from their current pressurization levels. However, the unloading sequence may require inflation or deflation of the target support bladder 30*a* and or inflation or deflation of any of the adjacent support bladders 30*b* to the appropriate level as determined by the controller at step 105, by the same or similar manner as described above, according to the condition of the support bladders 30 immediately preceding the execution current execution of step 106.

At step 107, a new user input can be communicated to the controller 110 from the user interface 116. The controller 110 receives the new user input to determine a new target support bladder 30*a* based on the new user input. If a new user input is communicated, in a similar manner as discussed above, the controller 110 returns to steps 103-106, and based on the new user input performs determining a new location of greatest load pressure 28*a*, determining a new sacrum location 50, calculating a new inflation amount for adjacent support bladders 30*b*, and or providing control signals for new pressurization levels of any of the support bladders 30. In the description above, in returning to steps 103-106, the controller 110 produces a new result for each step. However, in returning to steps 103-106, the result of any step based on the new user input may be the same result as the previous execution of the step, according to the magnitude of the impact of the new user input on the individual step of the sequence.

In the illustrative embodiment, the controller 110 performs revision of steps 103-106, based on new inputs from the transducers 92, and or other bed components. The controller 110 periodically receives a new input from the transducer and revises the steps 103-106 based on that new input. In some embodiments, the controller may perform revisions upon a triggering event such as change in the pressure inputs from the transducers 92, a user initiation, or by any combination thereof.

At step 108, the controller 110 determines whether the patient is in a fetal position. In the illustrative embodiment, the controller 110 determines whether a user has selected the fetal position on the user interface 116. In some embodiments, the controller 110 may determine whether the patient is in the fetal position by execution of instructions stored in the memory device 117 by processor 113 based on pressure inputs from the transducers 92 and or other inputs received from other bed components. If the controller 110 determines the patient is in the fetal position, the controller 110 performs steps 109-111. At steps 109-111 of the illustrative embodiment, the controller 110 selects the target support bladder 30*a* based on inputs from the transducers 92 indicating a load pressure over each of the support bladders 30. In some embodiments the controller 110 may selects the target support bladder 30*a* based on inputs from any of the user interface 116, the transducers 92, and or other bed components. At steps 112-114, the controller 110 calculates the amounts of inflation to be provided to adjacent support bladders 30*b* to achieve unloading and communicates command signals to any of the pressurized fluid source 100, valves 104, and or other bed components to achieve the calculated amounts of inflation. At step 114, new user input can be inputted to the unloading sequence.

At step 109, the controller 110 determines the location of greatest load pressure 29*a* on the patient support surface 16 based on inputs from the transducers 92 indicating the pressure levels within the support bladders 30. The processor 113 executes instructions stored in the memory device 117 according to inputs from the transducers 92 to determine the location of greatest load pressure 29*a* on the patient support surface 16. The controller 110 stores the determined location of greatest load pressure 29*a* and the load input information in the memory device 117. In the illustrative embodiment, the controller 110 determines the location of greatest load pressure 29*a* on the patient support surface 16 based on pressure inputs from the transducers 92 of the entire mattress 28. In some embodiments, the controller 110 determines the location of greatest load pressure 29*a* based on transducer 92 inputs from one or more specific regions of the mattress 28, such as the central region 35.

At step 110, the controller 110 determines the location of the patient's trochanter. Processor 113 executes instructions stored in the memory device 117 based on the determined location of greatest load pressure 29*a* from step 109 to determine the location of the patient's trochanter 60. The controller 110 stores the location of the patient's trochanter 60 in the memory device 117. In the illustrative embodiment, the controller 110 determines the location of the trochanter 60 to be the same as the location of greatest load pressure 29*a*. In some embodiments, the controller 110 may determine the location of the patient's trochanter 60 at a position different from the location of greatest load pressure 29*a* according to the inputs from the transducers 92.

The controller 110, at step 111, selects a support bladder 30 corresponding to the location of the patient's trochanter 60 as the target support bladder 30*a*. The processor 113 executes instructions stored in the memory device 117 to select the support bladder 30 corresponding to the location of the patient's trochanter 60 identified at step 110, and the controller 110 deems the selected support bladder 30 as the target support bladder 30*a*. The controller 110 stores the selection in the memory device 117.

At step 112, the controller 110 calculates the amounts of inflation to be provided to adjacent support bladders 30*b* based on the pressure inputs from the transducers 92. The processor 113 executes instructions stored in the memory device 117 to determine the amounts of inflation required of each of two adjacent support bladders 30*b* which are adjacent to the target support bladder 30*a*. The instructions include a number of control algorithms to determine a required amount of increased support pressure required from the adjacent support bladders 30*b* to accommodate unloading of the trochanter without unduly increasing the interface pressure in the surrounding areas of the patient 98. The amounts of inflation required are determined based on the inputs from the transducers 92 received by the controller 110. In the illustrative embodiment, the amounts of inflation are calculated based on the total patient's body weight as indicated by the inputs from the transducers 92. In some embodiments, the amounts of inflation may be calculated based on the distribution of the patient's body weight, inputs from the user interface 116, other inputs to the controller 110 indicating bed configuration, and or any combination thereof. The adjacent support bladders 30*b* may include any number of support bladders 30. In the present embodiment, the amounts of inflation of the adjacent support bladders 30*b* are embodied as individual amounts of inflation. In some embodiments, the amounts of inflation may be common to adjacent support bladders 30*b*.

The processor 113, at step 113, communicates to the pressurized fluid source 100 and valves 104 to deflate the target support bladder 30*a* and to inflate two adjacent support bladders 30*b* their amounts according to step 112. The unloading sequence is described as requiring deflation of the target support bladder 30*a*, and or inflation of the adjacent support bladders 30*b*, from their current pressurization levels. However, the unloading sequence may require inflation or deflation of the target support bladder 30*a* and or inflation or deflation of any of the adjacent support bladders 30*b* to the appropriate level as determined by the controller at step 112, by the same or similar manner as described above, according to the condition of the support bladders 30 immediately preceding the current execution of step 113.

At step 114, a new user input can be communicated to the controller 110 from the user interface 116. The controller 110 receives the new user input to determine a new target support bladder 30*a* based on the new user input. If a new user input is communicated, in a similar manner as discussed above, the controller 110 returns to steps 110-113, and based on the new user input performs determining a new location of greatest load pressure 28*a*, determining a new sacrum location 50, calculating a new inflation amount for adjacent support bladders 30*b*, and or providing control signals for new pressurization levels of any of the support bladders 30. In the description above, in returning to steps 110-113, the controller 110 produces a new result for each step. However, in returning to steps 110-113, the result of any step based on the new user input may be the same result as the previous execution of the same step, according to the.

In the illustrative embodiment, the controller 110 performs revision of steps 110-113, based on new inputs from the transducers 92, and or other bed components. The controller 110 periodically receives a new input from the transducer and revises the steps 110-113 based on that new input. In some embodiments, the controller may perform revisions upon a triggering event such as change in the pressure inputs from the transducers 92, a user initiation, or by any combination thereof.

At step 115, the controller 110 executes a custom unloading sequence. At steps 116-117, the controller 110 receives inputs from the user interface 116 indicating a selection by a user for custom unloading. Inputs include any of user selection of a user-selected target support bladder 32 and user adjustment of mattress 28 and or bed 10 parameters. At steps 118-120, the controller 110 selects the target support bladder 30*a* based directly on the user-selected target support bladder 32 via the user interface 116. The controller 110 calculates the amounts of inflation to be provided to adjacent support bladders 30*b* to achieve unloading and communicates control signals to any of the pressurized fluid source 100, valves 104, and or any other bed component to achieve the calculated amounts of inflation. At step 121, a new user input can be inputted to the unloading sequence.

Figure 4:
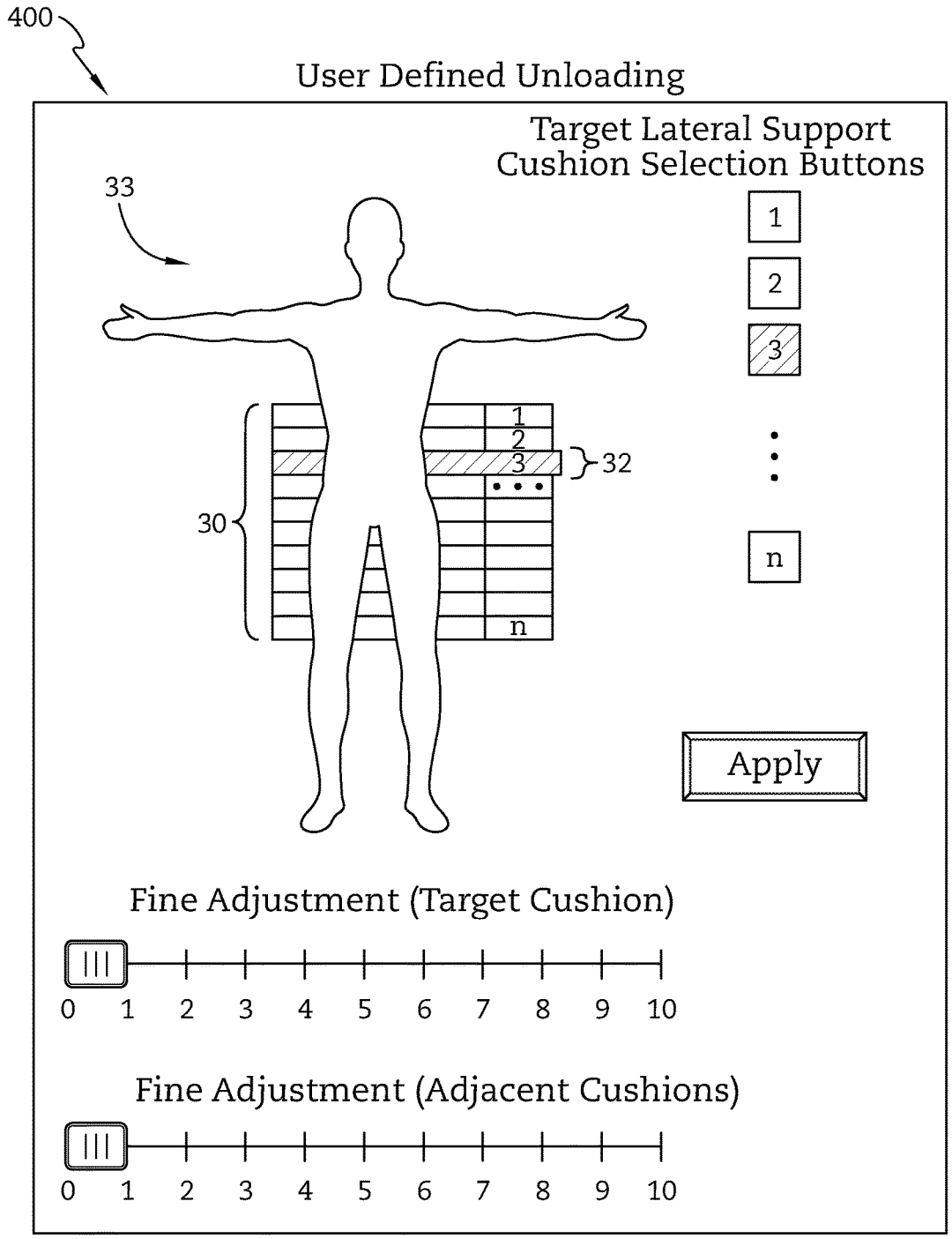
FIG. 4 is a diagrammatic representation of a user interface used to interface with the control system of the patient support apparatus to cause the control system to operate the bladder systems.

At step 116, the user selects a user-selected target support bladder 32 on the user interface 116. User selection is embodied as direct user selection of the user-selected target support bladder 30*a*, but may also be embodied as indirect user selection. The controller 110 receives inputs from the transducers 92 indicating a load pressure on the patient support surface 16 and communicates the load pressure information to the user interface 116 for pictorial display 400 (see FIG. 4) for assisting the user in selecting the target support bladder 30*a* and adjusting other parameters. The pictorial display may include current, time-lapsed, or period-averaged load pressure information. The user interface overlays the load pressure information by color code onto a diagram 33 of the support bladders 30 shown on the user interface screen. In some embodiments, the load pressure information may be displayed on the user interface in any variety of ways to assist in user inputs including any of shading, coloring, or numbering. As shown in FIG. 4, the pictorial display indicates the current user-selected target support bladder 32 by displaying the corresponding support bladder 30 as depressed on the diagram 33. The current user-selected target support bladder 32 may be indicated by color, indicator, marker, and or any other indication means. The controller 110 receives the user-selected target support bladder 32 from the user interface 116 as user input.

At step 117, the user can adjust parameters of the mattress 28 on the user interface 116. Parameters of the mattress 28 include overall mattress firmness, fine adjustment of the target bladder pressurization levels, fine adjustment of adjacent support bladder pressurization levels, and or other preference-based settings. These user adjustments are embodied as performed via slider bar, but may be embodied as a percentage, or other user interface configuration. The controller 110 receives the user adjusted parameters from the user interface 116 as user input.

The controller 110, at step 118, selects the target support bladder 30*a* according to the user-selected target support bladder 32 at step 116. The processor 113 executes instructions stored in the memory device 117 to select a support bladder 30 corresponding to the user-selected target support bladder at step 116, and the selected support bladder 30 is deemed the target support bladder 30*a*. The controller 110 stores the selection in the memory device 117.

At step 119, the controller 110 calculates the amounts of inflation to be provided to adjacent support bladders 30*b*. The processor 113 executes instructions stored in the memory device 117 to determine the amounts of inflation required of each of two adjacent support bladders 30*b* which are adjacent to the target support bladder 30*a*. The instructions include a number of control algorithms to determine a required amount of increased support pressure to accommodate unloading of the trochanter without unduly increasing the interface pressure in the surrounding areas of the patient. The amounts of inflation required of the adjacent support bladders 30*b* are calculated based on input received from the transducers 92 by the controller 110. In the illustrative embodiment, the amounts of inflation are calculated based on the total patient's body weight as indicated by the inputs from the transducers 92. In some embodiments, the amounts of inflation may be calculated based on the distribution of the patient's body weight, inputs from the user interface 116, other inputs to the controller 110 indicating bed configuration, and or any combination thereof. The adjacent support bladders 30*b* may include any number of support bladders 30. In the present embodiment, the amounts of inflation of the adjacent support bladders 30*b* are embodied as individual amounts of inflation. In some embodiments, the amounts of inflation may be common to adjacent support bladders 30*b*.

The processor 113, at step 120, communicates to the pressurized fluid source 100 and valves 104 to deflate the target support bladder 30*a* and to inflate the two adjacent support bladders 30*b* their calculated amounts of inflation according to step 119. The processor 113 sends command signals to the pressurized fluid source 100 and fluid valves 104 indicating the required valve positions and fluid source operating conditions to achieve the pressure levels determined at step 119. The custom unloading sequence is described as requiring deflation of the target support bladder 30*a*, and inflation of the adjacent support bladders 30*b*, from their current pressurization levels. However, the unloading sequence may require inflation or deflation of the target support bladder 30*a* and or inflation or deflation of any of the adjacent support bladders 30*b* to the appropriate level as determined by the controller at step 105, by the same or similar manner as described above, according to the condition of the support bladders 30 immediately preceding the execution current execution of step 120.

At step 121, a new user input can be communicated to the controller 110 from the user interface 116. The controller 110 receives the new user input to determine a new target support bladder 30*a* based on the new user input. If a new user input is communicated, in a similar manner as discussed above, the controller 110 returns to steps 117-120, and based on the new user input performs determining a new location of greatest load pressure 28*a*, determining a new sacrum location 50, calculating a new inflation amount for adjacent support bladders 30*b*, and or providing control signals for new pressurization levels of any of the support bladders 30. In the illustrative embodiment in returning to steps 117-120, the controller 110 produces a new result for each step. However, in returning to steps 117-120, the result of any step based on the new user input may be the same result as the previous execution of the step according to the magnitude of the impact of the new user input on the individual step of the sequence.

In the illustrative embodiment, the controller 110 performs revision of steps 117-120, based on new inputs from the transducers 92, and or other bed components. The controller 110 periodically receives a new input from the transducer and revises the steps 117-120 based on that new input. In some embodiments, the controller may perform revisions upon a triggering event such as change in the pressure inputs from the transducers 92, a user initiation, or by any combination thereof.

Figure 5A:
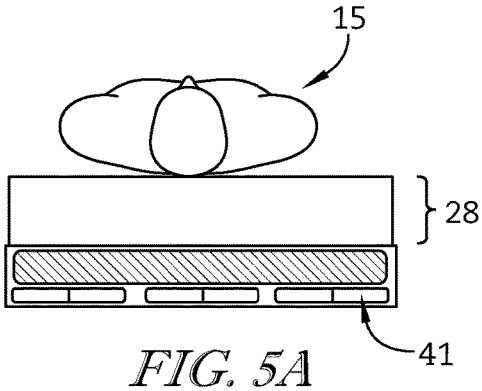
FIGS. 5A-5C are diagrammatic views of a portion of the control system of the patient support apparatus used to operate a rotation bladder system of the patient support surface.
Figure 5B:
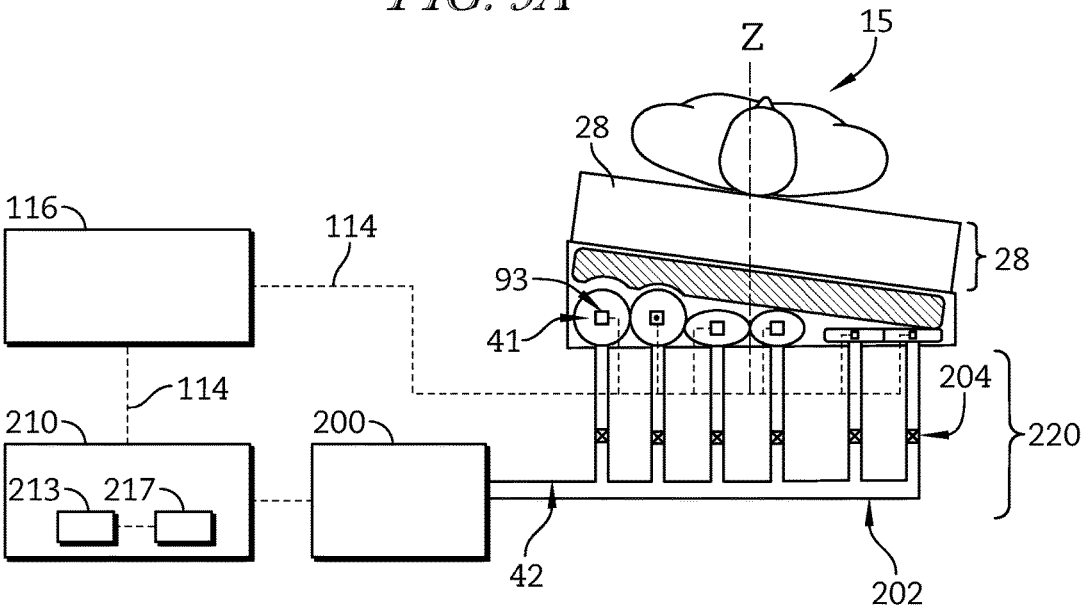
Figure 5C:
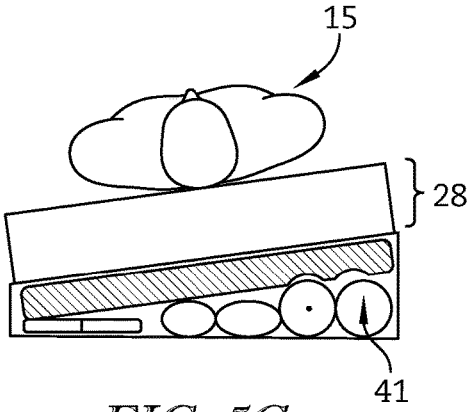
Figure 6:
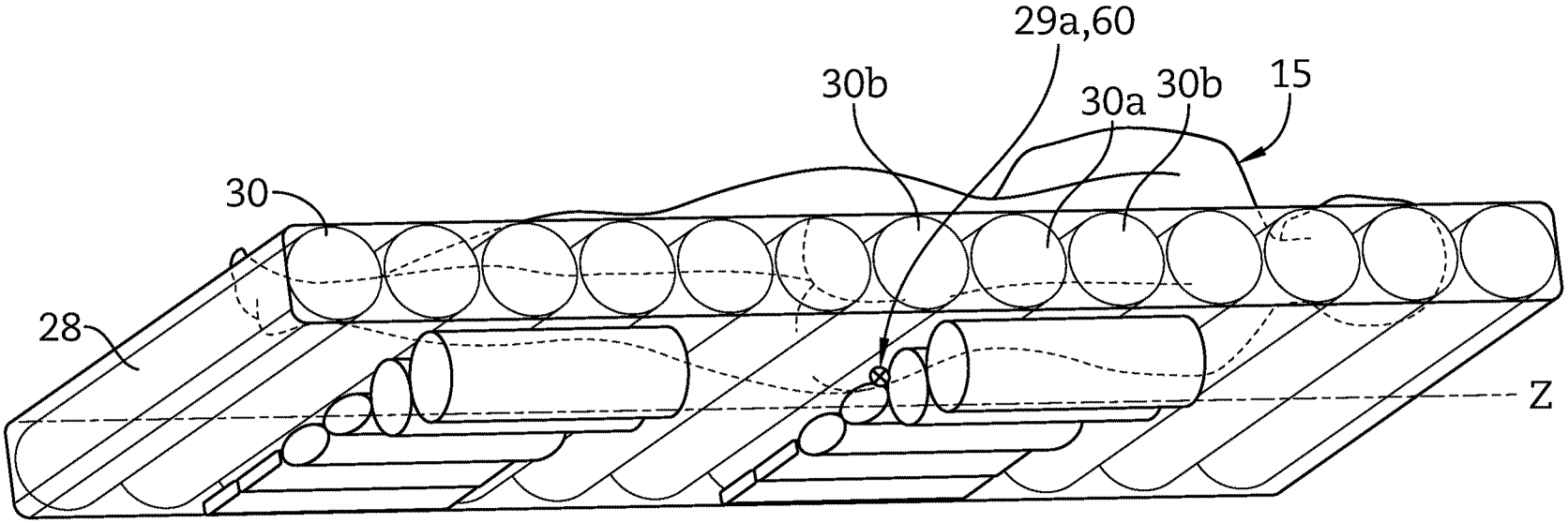
FIG. 6 is diagrammatic side view of the support bladders and rotation bladders of the patient support surface supported on the frame structure.

A user may operate the bed for lateral rotation of a patient as therapeutic for the patient, to assist in bed making, or to generally assist movement of the patient. A user can select performance of lateral rotation via the user interface 116. As illustrated in FIG. 5A, in the horizontal position, the rotation bladders 41 are in a deflated state. During lateral rotation the mattress 28 of the bed 10 is laterally rotated to a laterally inclined position by inflating rotation bladders 41 located on a corresponding side of the bed to elevate the bed side while maintaining rotation bladders 41 on the rotation side of the bed in a deflated state, as illustrated in FIGS. 5A-5C. In some embodiments, in the horizontal position of the mattress 28 the rotation bladders 41 may initially be in any of a deflated state, partially inflated state, or fully inflated state, and lateral rotation may be achieved by any combination of inflation and deflation of rotation bladders 41 on opposing sides of the bed. The disparate inflation amounts of the rotation bladders 41 create lateral inclination of the mattress 28 and corresponding lateral rotation of the patient support surface 16. Laterally inclining patient support surface 16 puts the bed's occupant in a laterally inclined position. Lateral rotation of the mattress 28 includes static user-selected lateral rotation and continuous lateral rotation therapy. Lateral rotation may include pressure unloading.

Static lateral rotation includes rotation of the mattress 28, and corresponding lateral rotation of the patient support surface 16, to any of a horizontal, right-inclined, or left-inclined position, relative to the floor as indicated in FIGS. 5A-5C. Static lateral rotation includes user-selection of a fixed laterally-rotated position. A user selects a direction, leftward or rightward, for static lateral rotation via the user interface 116 and may customize the inclination angle between a minimum and maximum range. The static lateral rotation is maintained until a different static position is entered over the user interface 116. The static lateral rotation can also be maintained for a predetermined duration before returning to a horizontal mattress position illustrated in FIG. 3B.

Continuous lateral rotation therapy (CLRT) includes periodic rotation of the mattress 28, and corresponding lateral rotation of the patient support surface 16, to any of a horizontal right-inclined, or left-inclined position, relative to the floor as shown in FIGS. 5A-5C. The angle of right-inclination, angle of left-inclination, and or duration of each position is set as a default configuration stored in the memory device 117. A user can adjust any of the angles of right-inclination, angle of left-inclination, and or duration of each position via the user interface 116 from zero to 100% of maximum range. A user may select to eliminate any of the right-inclined, left-inclined, and or horizontal positions from the cycle.

FIGS. 5A-5C illustrate the mattress 28 including rotation actuators, embodied as rotation bladders 41. The rotation bladders 41 extend generally along the longitudinal direction of the mattress 28. At least one rotation bladder 41 is positioned on either side of a center line z running longitudinal along the center of the mattress 28. In the illustrative embodiment, rotation bladders 41 generally have the same size, shape, and construction. In some embodiments, a rotation bladder 41 may differ from other rotation bladders 41 in size, shape and or construction dependent on its specific position with respect to the mattress 28.

In the illustrative embodiment, rotation bladders 41 on opposite sides of the center line z have mirrored configurations and extend generally from the head end 22 to the foot end 24 of the bed 10. The rotation bladders 41 are oriented with the same spacing between adjacent rotation bladders 41 and are a part of the mattress 28 without spacing between adjacent rotation bladders. In some embodiments, the rotation bladders 41 may extend along a limited portion or portions of the mattress 28; may have different spacing between adjacent rotation bladders; may be positioned in any other manner with respect to the support bladders 30; and or may be separate from the mattress 28 and attached directly or indirectly to the frame 12.

In FIG. 5B, rotation bladders 41 are inflated and deflated by a rotation pressurized fluid system 220. The rotation pressurized fluid system 220 includes a pressurized fluid source 200, pressurized fluid control valves 204, tubes 202, and controller 210. The controller 210 includes at least one processor 213 and at least one memory device 217. In the illustrative embodiment, rotation pressurized fluid system 220 is a separate pressurized fluid system from support bladder pressurization system 120 and controller 210 is embodied as a separate controller from controller 110. In some embodiments, rotation pressurized fluid system 220 is a combined fluid system with that of support bladder pressurization system 120, and may combine any of their components such as a common pressurized fluid source or sources, valves, tubing or other hardware or software components. The controller 210 may be the same controller as controller 110, a separate processor and memory device on the same board as controller 110, and or as sharing any of the components of controller 110.

Figure 7:
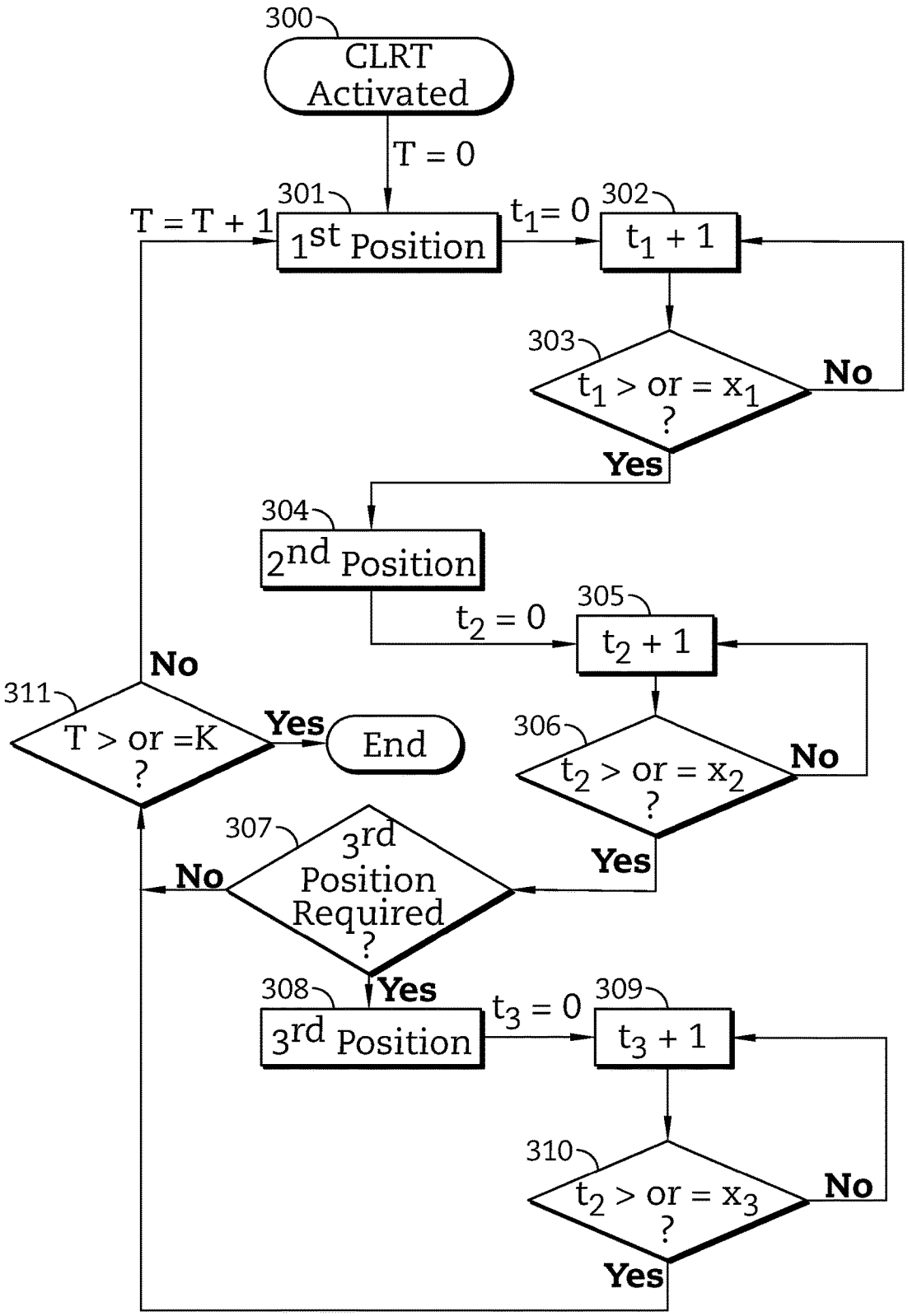
FIG. 7 is a flow diagram illustrating the steps used by the control system to control a continuous lateral rotation therapy (CLRT) function of the patient support surface.

FIG. 7 indicates a flow chart of a sequence of continuous lateral rotation therapy cycle. At step 300, CLRT is activated illustratively by a user selection via the user interface 116. At steps 301-303, the controller 210 sends command signals to the valves 204 and or pressurized fluid source 200 of the rotation actuator system 220 to activate the rotation bladders 41 to achieve the first position of the cycle. After the predetermined amount of time, at steps 304-306, the controller 210 sends command signals to the valves 204 and pressurized fluid source 200 of the rotation actuator system 220 to pressurize the rotation bladders 41 to achieve the second position of the cycle. At step 307, the controller 210 determines whether a third position is required. At steps 308, the controller 210 sends command signals to the valves 204 and or the pressurized fluid source 200 of the rotation actuator system 220 to activate the rotation bladder 41 to achieve the third position of the lateral rotation cycle for the predetermined duration. At step 311, an overall cycle counter T is increased.

At step 300, CLRT is activated illustratively by user initiation via the user interface 116. The processor 213 executes instructions to set an overall cycle counter T to zero and the overall count is stored in the memory device 217. In some embodiments, CLRT activation may be initiated periodically, by triggering event, by user initiation, or any combination thereof.

At step 301, the controller 210 receives inputs from the user interface 116 and the transducers 93. The processor 213 executes instructions stored in the memory device 117 based on the inputs from the user interface 116, transducers 93, to determine the first position of the CLRT cycle and the corresponding pressurization levels of the rotation bladders 41 to achieve the first position of the cycle. The processor 213 sends the inputs, mattress positions, and pressurizations levels, to the memory device 217 for storage. The controller 210 sends command signals to the valves 204 and pressurized fluid source 200 indicating their appropriate configuration, based on the results of the instructions, for achieving the determined first position. The controller 210 communicates to the controller 110 such that the controller 110 determines and controls the support bladder pressurization system 120 to pressurize the support bladders 30 to accommodate the first position of the CLRT cycle. The controller 210 monitors the position of the valves 204, pressurized fluid source 200 operation, pressures of the rotation bladders 41, position of the mattress, and or intermediate parameters to infer the positions, pressures, and operation, to determine when the first position of the CLRT cycle has been achieved by the mattress 28. When the controller 210 determines that the first position has been achieved, the controller 210 begins a first position counter $t_1$ from zero. In the illustrative embodiment, the rotation actuators are rotation bladders 41 operated by a rotation pressurized fluid system 220 including pressurized fluid source 200, valves 204, and tubes 202, but may be embodied as any type of actuator system to provide lateral rotation, including but not limited to, hydraulic, electric, and or magnetic actuators with commensurate actuation systems, and any combinations thereof including the processor 213 executing instructions to determine the commensurate actuator positions. The controller 210 operates to control each rotation bladder 41 individually. In some embodiments, the controller 210 may operate to control each rotation bladder 41 as part of a group of rotation bladders 41.

Steps 302 and 303 show an illustrative counter flow sequence. After the predetermined time $X_1$ has elapsed, the first position counter $t_1$ at step 303 is satisfied by achieving at least the predetermined time $X_1$, and the sequence progresses. The predetermined time $X_1$ is a default time stored in the memory device 117 but can be adjusted by a user on the user interface 116.

At step 304, the controller 210 receives inputs from the user interface 116 and the transducers 93 and controls the rotation actutator system 220 to achieve the second position of the CLRT. The processor 213 executes instructions stored in the memory device 217 based on the inputs from any of the user interface 116 and the transducers 93 to determine the second position of the CLRT cycle and the corresponding pressurization levels of the rotation bladders 41 to achieve the second position of the cycle. The processor 217 sends the inputs, positions, pressurizations levels, or intermediate information to the memory device 217 for storage. The controller 210 sends command signals to the valves 204 and or pressurized fluid source 200 providing their appropriate configuration, based on the results of the instructions, for achieving the second position of the cycle. The controller 210 communicates to the controller 110 such that the controller 110 determines and controls the support bladder pressurization system 120 to pressurize the support bladders 30 to accommodate the second position of the cycle. The controller 210 monitors the position of the valves 204, operation of pressurized fluid source 200, pressures of rotation actuators 41, and position of the mattress 28 to determine when the second position of the CLRT cycle has been achieved by the mattress 28. When the controller 210 determines the second position of the cycle has been achieved, the controller 210 begins a second position counter $t_2$ from zero.

Steps 305 and 306 show a timer or counter configuration. After the predetermined time $X_2$ has elapsed, the second position counter at step 306 is satisfied, and the sequence progresses. The predetermined time $X_2$ is a default time stored in the memory device 117 but can be adjusted by a user on the user interface 116.

At step 307, the controller 210 determines whether a third position is required according to the user selections for the CLRT cycle via the user interface 116. The controller determines whether a third position is required according to default conditions stored within the memory device 217. If the third position is not required, for example, when deselected by a user via the user interface 116; the sequence progresses to step 311. If the third position is required, the sequence progress to step 308.

At step 308, the controller 210 receives inputs from the user interface 116 and the transducers 93. The processor 213 executes instructions based on the inputs to determine the third position of the CLRT cycle and the corresponding pressurization levels of the rotation bladders 41 to achieve the third position of the cycle. The processor 213 sends the inputs, positions, pressurizations levels, or intermediate information to the memory device 217 for storage. The controller 210 sends command signals to any of the valves 104 and or pressurized fluid source 200 indicating their appropriate configuration, based on the results of the instructions, for achieving the third position of the cycle. The controller 210 communicates to the controller 110 such that the controller 110 determines and controls the support bladder pressurization system 120 to pressurize the support bladders 30 to accommodate the third position of the cycle. The controller 210 monitors the position of the valves, pressurized fluid source operation, rotation actuator position, position of the mattress, to determine when the third position of the cycle has been achieved by the mattress 28. When the controller 210 determines that the third position has been achieved, the controller 210 begins a third position counter $t_3$ from zero. The controller 210 sets the overall cycle counter T to increase.

At step 311, the controller 210 determines if the overall cycle counter is equal to or greater than the predetermined time K. If the predetermined time K has been achieved or exceeded by the overall cycle counter T, the sequence ends and the controller 210 sends commands signals to the valves 204 and pressurized fluid source 200 to configured the rotation bladders to achieve the horizontal position. If the predetermined time K has not been achieved or exceeded, the sequence returns to step 301.

Figure 8:
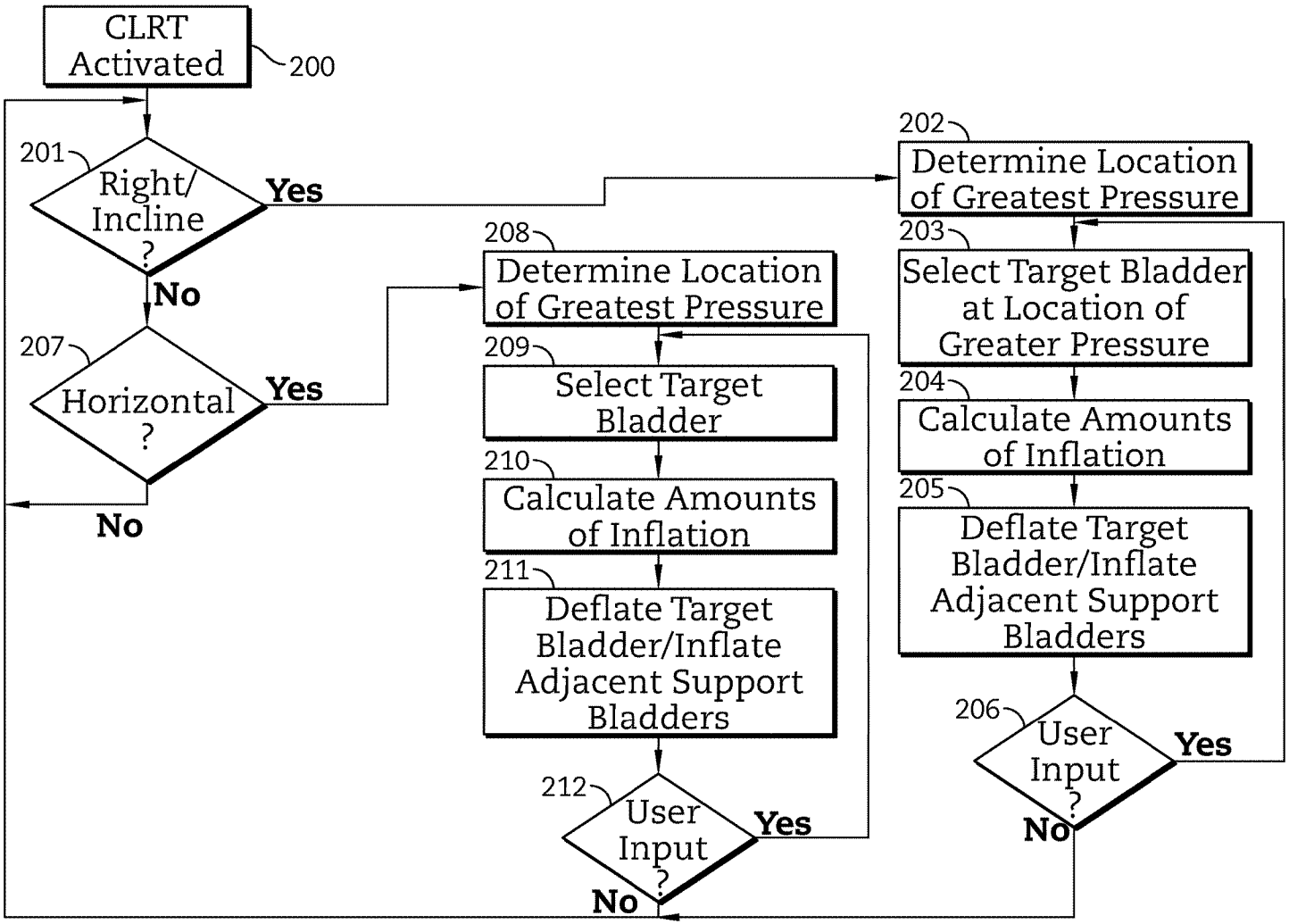
FIG. 8 is a flow diagram similar to that of FIG. 7, illustrating the steps used by the system to control the patient support apparatus to cause an unloading sequence to be performed similar to that shown in FIG. 3, simultaneously with the CLRT function of FIG. 8.

Lateral rotation can be performed with an unloading sequence as described above. The operations illustrated by the flow charts of FIGS. 7 and 8 are shown in separate figures but illustratively operate in parallel. While the mattress 28 is in the first position at step 301, the controller 210 determines whether unloading sequence has been selected by a user via the user interface 116. If an unloading sequence has been selected, the controller 210 sends an initiation signal to the controller 110 to begin the sequence illustrated in FIG. 8. At step 201, the controller 110 illustratively determines whether a right or left inclination is active as indicated by the initiation signal from controller 210. If a right or left inclined position is determined to be active, the sequence progresses to step 202. Steps 202-206 operate similarly to the steps described above for unloading. If an inclined position is not determined to be active, the sequence progresses to step 207 to determine if a horizontal position is active. If a horizontal position is active, the sequence progresses to step 208 for unloading. Steps 208-212 operate similarly to the steps described above for unloading. In some embodiments, controller 110 may directly determine whether an unloading sequence has been selected via the user interface 116, and or may determine whether a right or left inclination is active by inputs from the transducers 92 and or any other bed component.

In some embodiments, the operations of FIGS. 7 and 8 may be combined. For example, step 200 in FIG. 8 may operate in parallel at each of steps 301, 304, and 308 or may be integrated as additional steps of the same operation. Inputs from the user interface, transducers 92, 93, and or any other bed component are stored in the memory devices 117, 217 and referenced by the processors 113, 213 throughout the unloading and or rotation processes. In some embodiments, the controller 110 may determine whether a right or left inclination is active by execution of instructions stored in the memory device 117 by the processor 113 based on pressure inputs from the transducers 92 and or other inputs received from other bed components.

When a user selects a custom unloading mode in combination with a CLRT cycle, the controller 110 selects the target support bladder 30*a* at steps 203 and 209 in accordance with the user-selected target support bladder 32 and calculates the inflation amount at steps 204 and 210 in accordance with the user-adjusted parameters. The user can select a different user-selected target support bladder 32 for each position of the CLRT cycle. The custom inputs are retained in the memory device 117 and used as inputs to the execution of the instructions by the processor 113 throughout the CLRT cycle and/or until modified by the user.

Each of the instructions of the illustrative embodiment include one or more control algorithms stored in the appropriate memory devices 117, 217 and executed by the appropriate processors 113, 213. In some embodiments, the instructions may include reference charts, lookup tables, or the like and may be updated through a communication link to support debugging, enhanced features, and or updated control design.

In some embodiments, the described determinations, identifications, selections, and calculations are embodied to include consideration of previously stored information regarding any of the patient, the mattress 28, the bed 10, user inputs, transducer input, and or other information relevant to configuration of the mattress 28 as variables of the instructions.

In some embodiments, the described determinations, identifications, selections, and calculations may be embodied to include consideration of any of currently existing, and or predicted information, regarding any of the patient, the mattress 28, the overall bed 10 or components thereof, information regarding any of inputs from the user interface 116, transducers 92, 93, and or any other bed component, and or other information relevant to configuration of the mattress 28 as variables of the instructions.

In some embodiments, the described determinations, identifications, selections, and calculations performed by the controller may include consideration of any of currently existing, and or predicted information, regarding any of the patient may include consideration of previously stored, currently existing, or predicted information, regarding the patient, the mattress 28, the overall bed 10 or bed components, information from inputs from the user interface 116, transducers 92, 93, and or other bed components, and or other information relevant to configuration of the mattress 28 as variables of the instructions. In the illustrative embodiment, calculation of amounts of inflation for adjacent support bladders includes only calculation for the adjacent support bladders. In some embodiments, this calculation may include calculation of amounts of inflation for the target support bladder.

Any and or all user inputs include any user selection of operational preferences, toggling on/off of bed functions, adjustments to bed operations and or positions, and or any other direct or indirect user influence over bed configuration via the user interface 116.

Any and or all communication links may be partly or wholly wired with either permanent or detachable connections, and may also comprise wireless communication, or any combination of wiring and wireless configurations.

The patient support apparatus may be used in combination with various other patient support auxiliary devices and configurations including systems which may provide additional inputs to the controllers 110, 210 for consideration during execution of any instructions.

Although certain illustrative embodiments have been described in detail above, variations and modifications exist within the scope and spirit of this disclosure as described and as defined in the following claims.

We claim:

1. A patient support system comprising:

a mattress, the mattress including a plurality inflatable support cushions for supporting a patient's body; and a controller including at least one processor and at least one memory device, the at least one memory device including instructions that, when executed by the at least one processor, (i) determine a position of the patient's body on the mattress and (ii) select at least one inflatable support cushion of the plurality of inflatable support cushions as a target inflatable support cushion for deflation based on the determined position of the patient's body, wherein the memory device includes instructions that, when executed by the processor, causes the controller to deflate the target inflatable support cushion and increase the inflation of at least one inflatable support cushion adjacent to the target inflatable support bladder while maintaining an existing inflation level of the other inflatable support cushions.

2. The system of claim 1, wherein an inflation amount of the at least one adjacent inflatable support cushion is one of a predetermined amount and a calculated amount, to unload a sacral region and or a trochantal region without unduly increasing pressure in surrounding areas.

3. The system of claim 1, wherein the plurality of inflatable support cushions includes independently controllable bladders disposed laterally across a central region of the mattress.

4. The system of claim 1, wherein the controller selects the target inflatable support cushion based on a location of greatest pressure.

5. The system of claim 4, wherein the controller receives a least one pressure signal indicating the location of greatest pressure, and selects the target inflatable support cushion based on the pressure signal.

6. The system of claim 5, wherein the controller further selects the target inflatable support cushion based on a user input.

7. The system of claim 5, further comprising at least one pressure sensor for each of the plurality of inflatable support cushion selected from the group of: piezo-electric pressure sensor, an immersion sensor, a tape switch, and pressure-sensitive fabric.

8. The system of claim 5, further comprising at least one rotation actuator, wherein the at least one memory device includes instructions that, when executed by the at least one processor, operate the at least one rotation actuator such that the mattress performs a lateral rotation.

9. The system of claim 8, wherein the target inflatable support cushion corresponds to a location of a patient's trochanter.

10. The system of claim 8, wherein the controller adjusts at least one parameter of the lateral rotation based on a user adjustment input.

11. The system of claim 10, wherein the controller further selects the target inflatable support cushion based on a user input.

12. The system of claim 11, further comprising at least one rotation actuator; wherein the user input is a user selection of one of a supine position, a fetal position, and a custom target cushion mode.

13. The system of claim 12, wherein the at least one memory device includes instructions that, when executed by the at least one processor in response to user selection of the supine position, select the target inflatable support cushion as one of the plurality of inflatable support cushions located about 2-3 inches headward of an area of greatest pressure.

14. The system of claim 12, wherein the at least one memory device includes instructions that, when executed by the at least one processor in response to user selection of the fetal position, select the target inflatable support cushion as one of the plurality of inflatable support cushions located at an area of greatest pressure.

15. The system of claim 12, wherein the at least one memory device includes instructions that, when executed by the at least one processor in response to user selection of the custom target cushion mode, select the target inflatable support cushion as one of the plurality of inflatable support cushions based on a user selection of a specific inflatable cushion of the plurality.

16. The system of claim 1, wherein the target inflatable support cushion corresponds to a location of a patient's sacrum.

17. The system of claim 1, further comprising at least one rotation actuator; wherein the at least one memory device includes instructions that, when executed by the at least one processor, operate the at least one rotation actuator such that the mattress performs a lateral rotation.

18. The system of claim 17, wherein the controller receives a least one pressure signal indicating the location of greatest pressure during the lateral rotation, and selects the target inflatable support cushion based on the pressure signal.

19. The system of claim 18, wherein the lateral rotation is a continuous lateral rotation cycle and the controller selects the target inflatable support cushion based on a current position of the continuous lateral rotation therapy cycle.

20. The system of claim 19, wherein the current position is one of a rightward inclination, a horizontal position, and a leftward inclination.

21. A patient support system comprising:

a mattress, the mattress including a plurality inflatable support cushions for supporting a patient's body; and a controller including at least one processor and at least one memory device, the at least one memory device including instructions that, when executed by the at least one processor, (i) determine a position of the patient's body on the mattress and (ii) select at least one inflatable support cushions of the plurality of inflatable support cushions as a target cushions for deflation based on the determined position of the patient's body, wherein the at least one memory device includes instructions that, when executed by the at least one processor in response to user selection of the supine position, select the target inflatable support cushion as one of the plurality of inflatable support cushions located about 2-3 inches headward of an area of greatest pressure.

* * * * *